US006772533B2

(12) United States Patent
Hassinen et al.

(10) Patent No.: US 6,772,533 B2
(45) Date of Patent: Aug. 10, 2004

(54) ARRANGEMENT IN THE DRYING SECTION OF A PAPER MACHINE

(75) Inventors: Reijo Hassinen, Leppävesi (FI); Jari Jonkka, Jyväskylä (FI); Markku Lyytinen, Jyväskylä (FI); Mika Saari, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/469,936

(22) PCT Filed: Mar. 6, 2002

(86) PCT No.: PCT/FI02/00173

§ 371 (c)(1),
(2), (4) Date: Jan. 30, 2004

(87) PCT Pub. No.: WO02/070819

PCT Pub. Date: Sep. 12, 2002

(65) Prior Publication Data

US 2004/0128854 A1 Jul. 8, 2004

(30) Foreign Application Priority Data

Mar. 6, 2001 (FI) ..... 20010441

(51) Int. Cl.[7] ..... F26B 11/02
(52) U.S. Cl. ..... 34/120; 34/114; 34/122
(58) Field of Search ..... 34/113, 114, 115, 34/116, 117, 120, 121, 122

(56) References Cited

U.S. PATENT DOCUMENTS 4,416,070 A 11/1983 Vedenpä et al.
4,516,330 A * 5/1985 Eskelinen et al. ..... 34/456
4,669,198 A * 6/1987 Wedel ..... 34/456
5,068,980 A * 12/1991 Muller ..... 34/117
5,086,571 A * 2/1992 Hietanen ..... 34/117
5,163,236 A * 11/1992 Heikkila ..... 34/115
5,232,554 A * 8/1993 Kotitschke ..... 162/193
5,515,619 A 5/1996 Kahl et al.
5,600,897 A 2/1997 Sollinger et al.
5,735,060 A 4/1998 Atzinger et al.
5,881,472 A 3/1999 Grunder et al.

FOREIGN PATENT DOCUMENTS

EP 0 479 748 A1 9/1991
EP 0 640 716 B1 6/1994
WO WO 00/46445 A1 8/2000
WO WO 02/070819 A1 9/2002

OTHER PUBLICATIONS

International Search Report issued in international patent application PCT/FI02/00173.
International Preliminary Examination Report issued in international patent application PCT/FI02/00173.

* cited by examiner

*Primary Examiner*—Ira S. Lazarus
*Assistant Examiner*—Kathryn S. O'Malley
(74) *Attorney, Agent, or Firm*—Stiennon & Stiennon

(57) ABSTRACT

A multi-cylinder dryer of a paper machine, has at least one drying cylinder (10) and at least one roll (11, 12) located at a different height to the cylinder and at a distance to it in the machine direction. A paper web (14) travels from the drying cylinder (10) to this roll (11, 12). Dry air is brought to the dryer through a beam (13) located in front of the web (14) in the machine direction, the air is directed by means of nozzles (33) in the beam into a throat (21) between the drying cylinder (10) and the web (14) mainly to intensify the drying effect. A doctor (27) keeps the surface of the drying cylinder clean. The beam (13) forms with the roll (12) a smooth, high channel (25), at least on the side of the roll (12), for the passage of the web during a disturbance.

21 Claims, 2 Drawing Sheets

ARRANGEMENT IN THE DRYING SECTION OF A PAPER MACHINE

CROSS REFERENCES TO RELATED APPLICATIONS

This application is a U.S. National Stage application of International Application No. PCT/FI02/00173, and claims priority on Finnish Application No. 20010441, Filed Mar. 6, 2001.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to an arrangement in a multicylinder dryer of a paper machine, which arrangement includes at least one drying cylinder and at least one roll located at a different height to the cylinder and at a distance to it in the machine direction, the paper web traveling from the drying cylinder to this roll and, in which arrangement dry air is brought to the dryer through a beam located in front of the paper web in the machine direction, in which dryer the air is directed by means of nozzles arranged in the beam into a throat between the drying cylinder and the paper web, mainly to intensify the drying event, while a doctor is arranged in, or in connection with the said beam, to keep the surface of the drying cylinder clean.

In the drying section of a paper machine, blow boxes, i.e. ventilators, are used as components that both intensify drying and improve runnability. Doctor devices are used in the drying section to keep the cylinders clean. Generally these devices are located in pockets between the drying cylinders and rolls, so that the doctor is attached to its own frame above the pocket while the ventilator forms its own box beneath this in the lower part of the pocket. In an inverted drying group, these positions are reversed. In this connection, the term roll refers, for example, to a vacuum roll, or to a roll in which a suction effect is induced on the surface of the roll by some other means.

A vacuum, which creates a flow of air moving from the edges of the web to its center, arises in the throat opening between the drying cylinder and the wire. This creates flutter in the edges of the paper web in the area between the drying cylinder and the roll, so that the web lifts off the drying cylinder and may even begin to follow the surface of the drying cylinder. To eliminate this phenomenon, it is advantageous to fill the vacuum by directing a jet of air produced by the ventilator into the open throat. In addition, ventilation can be used to reduce the moisture difference between the edges and the center of the web, thus improving the web's cross-direction moisture profile. For this to operate as intended, the ventilator's air jet must be oriented correctly and the permeability of the drying wire and the amount of air blown must be correctly dimensioned.

At present, the doctor equipment is located in the lower pocket of the drying cylinder, above the blow box, attached to its own separate frame. The doctor blade, which is loaded against the drying cylinder, is attached to its holder frame. The doctor equipment is oscillating backwards and forwards in the crossdirection of the machine against the surface of the drying cylinder, from which it cleans impurities adhering to the cylinder.

In the case of wider dryers and faster paper machines, the separate doctor frame and ventilator fill the pocket below the drying cylinder so tightly that, at present, detrimental compromises in certain important functions are inevitable. The replacement air brought by the ventilator cannot be directed effectively enough into the throat opening between the drying cylinder and wire, so that the detrimental vacuum formed there creates transverse air currents that cause flutter at the edges of the web. If the doctor frame is located close to the drying cylinder, temperature differences arise over its cross section, resulting in warping of the doctor frame and poorer blade contact against the drying cylinder. In addition, a reliable and safe attachment location is required for the sensitive control and measurement sensors. In its present unsatisfactory location on a tube beam fitted on the outer circumference of the roll, the web-monitoring sensor may collect paper shreds that cause it to transmit incorrect information on the state of the running of the web. Paper shreds collecting on top of the sensor will indicate that the web is in place, even though the web is broken at, or before the point in question. The unsatisfactory shape of the ventilators causes them to collect broke during a web break, making their blockage a maintenance problem by requiring repeated cleaning. Lumps of wet paper collecting on a ventilator during a break can, in the worst case, damage the drying wire.

Patent publication FI-62571 (U.S. Pat. No. 4,416,070) discloses a combined doctor-ventilator. This method of attaching the doctor blade is characterized by its frame being located very close to the hot drying cylinder. This causes the doctor frame to deflect due to the temperature differences, thus leading to poorer contact of the blade against the drying cylinder. The dynamic pressure effect of the blown air is directed to a narrow area in the throat opening between the drying cylinder and the paper web. In addition, the arrangement has no suitable places in which the sensitive web-monitoring and measurement sensors can be attached safely. The shape of the doctor frame is also such that it readily collects paper shreds and broke.

In the doctor disclosed in the publication, the doctor blade is attached directly to a doctor beam, which is turned between a maintenance position and an operating position. The loading profile of the doctor beam must remain uneven.

U.S. Pat. No. 5,881,472 discloses a concept, in which a current of air is blown into the opening throat by means of a separate ventilator. A separate doctor frame is used to direct the airflow into the opening throat. However, this solution has many corners and, the components are separate from each other, they easily collect paper shreds and broke. This solution too has no advantageous locations for web-monitoring and measurement sensors. The directing of the ventilation is also poor, as the inconvenient location of the components prevents the formation of suitable baffles, which would allow the dynamic pressure effect to be effectively directed at the opening throat.

SUMMARY OF THE INVENTION

The invention is intended to create a new type of arrangement for directing ventilation air into the throat opening between the drying cylinder and the paper web and to improve the unimpeded removal of paper shreds into the basement in the case of disturbances in operation. The arrangement according to the invention can be used to achieve a significantly improved drying event. Dry hood replacement air is blown closer and more precisely directed into the opening throat, allowing edge flutter caused by transverse air currents to be prevented by adjusting the amount of air. Besides runnability, drying is also significantly improved, as the web surface is ventilated over a greater distance than at present in the area between the drying cylinder and the roll. In the arrangement, a doctor apparatus disclosed in the applicant's FI publication 105577, fitted on top of the doctor beam of the drying section, is preferably used as the doctor, so that the holder frame of the doctor forms a smooth continuation to the combined structure, directed to the throat. Loading devices, which are separate from the beam's operating devices, are provided for the doctor blade. The beam itself can also be moved farther from the hot drying cylinder while, on the other hand, it becomes possible to provide adjustment of the doctor-blade load, which has not been previously used in the drying section.

The doctor is arranged jointly with the roll to form a smooth, high channel for the passage of the web during disturbances, at least on the side next to the roll. The height of the channel is many times greater than the width of its projection.

The doctor blade contact in the edge area is also improved, because the structure supporting the doctor blade is not subject to deflection due to temperature differences. This is of particular benefit in tail threading. Equipment costs drop while the drying effect increases. The improved drying effect of the ventilation brings savings in the drying section by reducing the number of drying cylinders and rolls. The beam's advantageous smooth shape completely eliminates, from the area of the lower pocket of the drying cylinder, surfaces that might collect broke. Preferably the profile of the beam is high in relation to its width. At the same time, more space than before is reserved for the passage of the web. Safe spaces, where they cannot collect broke or be damaged, are now reserved for the web-monitoring and moisture-profile measuring sensors.

In the following, the invention is examined in greater detail with reference to the accompanying drawings depicting the invention, which is not restricted to the details shown.

DESCRIPTION OF THE PREFERRED EMBODIMENTS

Figure 1:
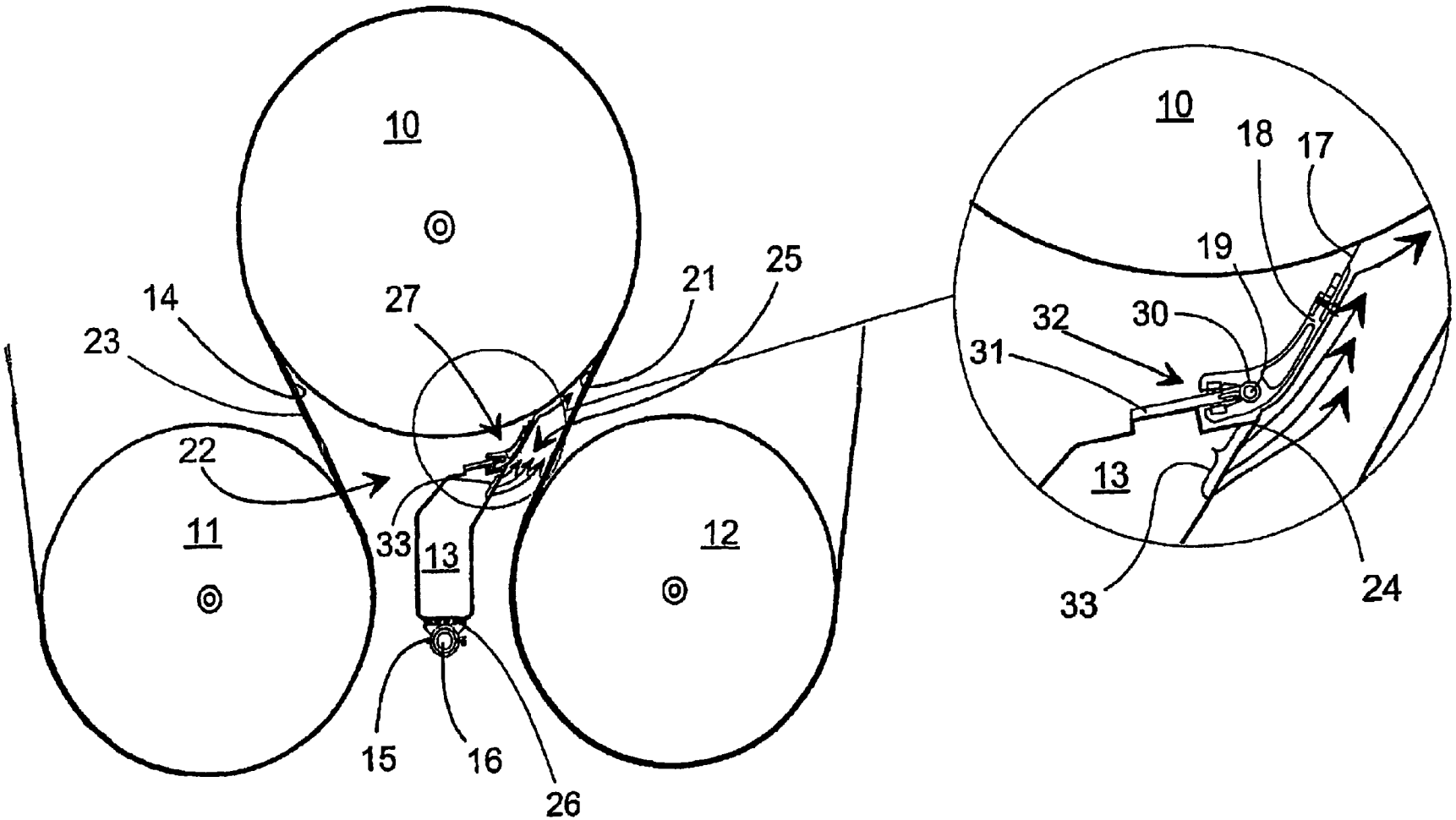
FIG. 1 shows the arrangement according to the invention, seen in a side view as a schematic diagram.

FIG. 1 shows a schematic side view of the arrangement according to the invention. The arrangement according to the invention relates to the drying section of a paper machine and particularly the space delimited by, in sequence, a first vacuum roll 11, a drying cylinder 10, and a second vacuum roll 12. In this connection, the term paper machine also refers to a board machine or any other similar machine. In place of the vacuum roll 11, 12, there may also be a roll in which a suction effect is created on the surface of the roll by some other means than a vacuum. The order of the components is defined according to the direction of travel of the paper web 14, which in the figure is from left to right. In this example, the components are located in relation to each other in such a way that the vacuum rolls 11, 12 are mainly below the drying cylinder 10 and at a distance to each other in the machine direction. In an inverted dryer group, in which the arrangement according to the invention can also be applied, the components are located with the vacuum rolls 11, 12 above the drying cylinder. The first and second vacuum roll 11, 12 and the drying cylinder 10 form between them a space, which is called the lower pocket of the drying cylinder, or usually just the pocket 22. The paper web 14 is supported on a drying wire 23 against, in sequence, the first vacuum roll 11, the drying cylinder 10, and the second vacuum roll 12. The paper web 14 travels between the drying wire 23 and cylinder 10, and on top of the drying wire 23 and the vacuum roll 11, 12. In the area of the vacuum roll 11, 12, the paper web 14 is also supported by the vacuum.

The combined ventilator and doctor beam 13 according to the invention, which hereinafter is generally called the beam 13, is located in the pocket 22 formed between the vacuum rolls 11, 12 and the drying cylinder 10. Dry air is blown into the throat 21, opening between the vacuum rolls 11, 12 and the paper web 14, from nozzles 33, which are set in the upper part of the beam 13 in the arrangement according to FIG. 1, and which are located close to the base 24 of the holder frame 18 of the doctor, as close as possible to the opening throat 21. The nozzles 33 of the beam 13 are used not only to direct replacement air into the throat 21, but also to increase the drying effect of the blowing, by means of the longer effective surface area between the drying cylinder 10 and the second vacuum cylinder 12. The nozzle construction closes the beam solution, thus increasing the necessary torsional stiffness of the beam 13.

From below, the beam 13 extends vertically in relation to a line running between the shafts of the rolls 11, 12. The holder frame 18 of the doctor 27 forms a smooth continuation to the beam 13 towards the opening throat 21, so that the distance of the holder frame 18 at right angles to the paper web 14 increases as the throat 21 opens in the direction of travel of the paper web 14. The beam 13 is shaped smooth at least on the side next to the second vacuum roll 12 in such a way that it forms a spacious and high channel 25 with the second vacuum roll 12. The opening angle of the exit throat 21 between the drying cylinder 10 and the web 14 is, in the upper part of the area between the doctor 27 and the beam 13, 3–10 degrees, preferably 5–8 degrees. The distance of the paper web 14 at right angles to the beam 13 does not decrease in the area of the channel 25 (except at the very bottom), as happens in the corresponding area in the prior art.

Attachment places for a moisture-profile measurement sensor 15 and a web-monitoring sensor 16 are arranged on the lower surface of the beam 13. Both have a location that is safe and optimizes the use of space. Both sensors 15, 16 are alternatives to each other, so that both sensors are not kept simultaneously on the same beam 13. A drying section can have at least one moisture-profile measurement sensor 15, measuring the moisture of the web over the entire width of the machine. There is also at least one web-monitoring sensor 16 in a paper machine, which is generally located on the tending-side edge of the beam 13.

The doctor blade 17 is attached to the upper part of the beam 13 by using a smoothly-shaped holder frame 18, in which a link bushing 30 opens backwards through a gap and the carrier 31 supporting the link pin 19 extends through the gap to the link bushing 30. Loading means 32 are used to load the doctor blade 17, in a manner that is, as such, known. The operation of the beam itself is simpler than previously. It is in either the operating or the maintenance position. The doctor 27 can be moved in the cross direction of the machine, against the drying cylinder 10. Known oscillating devices can be used to move the doctor 27. These permit either only the doctor blade 17 with the holder frame 18, or the beam 13 to be moved. The doctor blade 17 with the holder frame 18 can also be unmoveable.

Figure 2A:
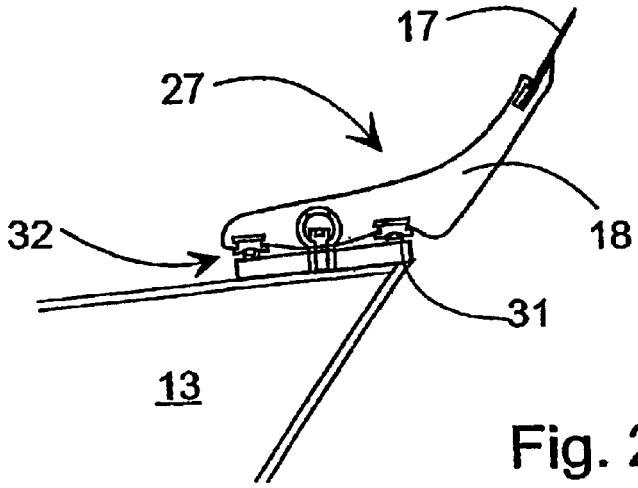
FIGS. 2*a*–2*c* show doctor solutions suitable for the arrangement according to the invention.
Figure 2B:
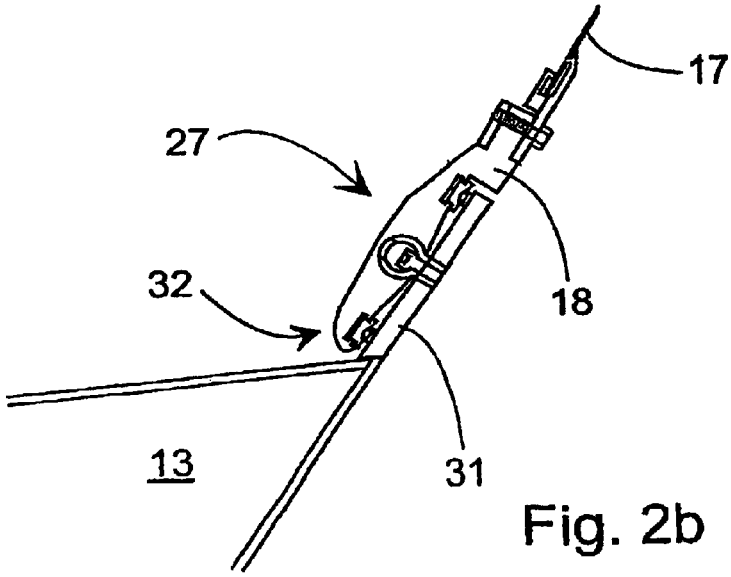
Figure 2C:
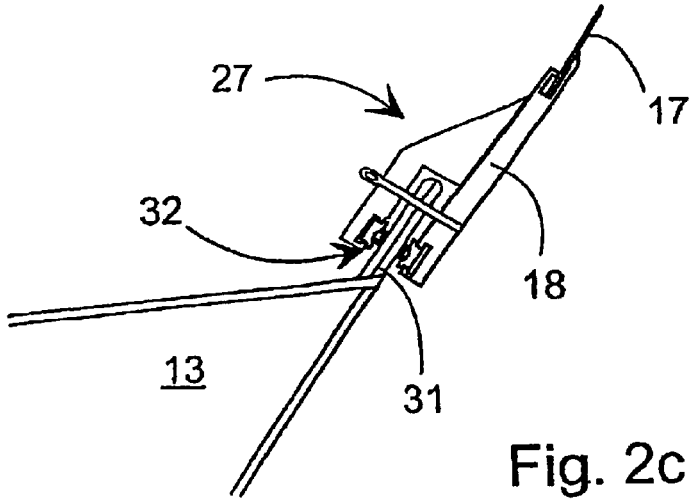

FIGS. 2*a*–2*c* show various doctor models, which are preferred to implement the arrangement according to the invention. The holder frames 18 of all of the doctors 27 form a smooth extension to the beam 13, which allow the web to be led to the basement level in cases of disturbances.

With the aid of both the shape of the beam 13 and the new type of doctor holder frame 18, a greater distance from the drying cylinder 10 is achieved, thus preventing warping in the beam 13 due to thermal expansion. The routing of the drying air along the curved lower surface of the holder frame 18 of the doctor 27 also increases the drying effect and directs it better into the opening throat 21.

The height and width of the beam 13 are preferably optimized, so that the beam 13 forms, together with the second vacuum roll 12, a channel 25 that opens out widely enough (in the example 6) for paper shreds to pass during disturbances. The height of this part (together with the doctor) is 3–5 times that of the narrowest part (at the point of the doctor). The distance of the beam 13 from the first vacuum roll 11 is mainly determined by the operating distance required by the web-monitoring sensor, and the space for passage required by tail threading. In its preferred form, the channel 25 also effectively guides the web 14 into the basement level during a web break, while the preferred shaping of the beam 13 will prevent the web from catching on anything. The height of the beam 13 is also determined by the width of the machine. With a wider machine there must be sufficient space inside the beam for even a large airflow too, which is blown from the nozzles 33 into the opening throat 21.

Solutions other than those disclosed above can also be used to implement the combined ventilator and doctor beam appearing in the arrangement according to the invention. The drying group can also be a so-called inverted group, in which the vacuum rolls are above the drying rolls. What is essential in the invention is the combination in the same structure 13 of the doctor frame and the ventilator, and the formation of a smooth, high channel 25 in the space between the beam 13 and the second vacuum roll 12, which is dimensioned with a powerful effect of the blown air and the web travel in a disturbance in mind. In addition, the ventilation is directed better than before into the opening throat 21 and over a longer distance on the web 14. The use of a beam 13 according to the invention provides safe locations for measurement sensors. The constructions of the arrangement are simple and reliable in operation. The beam 13 can be advantageously manufactured from glass-fibre or some other light and durable material and turned on a shaft to the operating and maintenance positions.

What is claimed is:

1. A multi-cylinder dryer in a paper machine, comprising:

a drying cylinder, having a drying surface;

at least one roll located at a different height than the drying cylinder and spaced a distance downstream in a machine direction from the drying cylinder;

a paper web having a section traversing the drying cylinder to the roll;

a beam located upstream of the paper web section in the machine direction, the beam forming an air duct, and a plurality of nozzles connected to the air duct to direct a stream of air into a throat formed between the drying cylinder and the paper web mainly to intensify the drying effect;

a doctor blade mounted to the beam and engageable with the drying surface of the drying cylinder to keep the surface clean;

loading devices supported by the beam and which engage the doctor blade;

wherein the beam and the doctor blade are arranged jointly, with the section of the paper web and the roll to form a smooth high channel, the smooth high channel defining an opening angle, the smooth high channel on an upstream side of the roll, the smooth high channel for passage of the web during a disturbance, and wherein the opening angle of the said channel is 3 to 10 degrees.

2. The apparatus of claim 1 wherein the doctor blade is attached to the beam by using a smoothly-shaped holder frame.

3. The apparatus of claim 1 wherein the beam is arranged to be turned around a shaft between an operating position and a maintenance position.

4. The apparatus of claim 1 wherein the attachment locations for a moisture sensor and a web-monitoring apparatus are arranged on a bottom portion of the beam.

5. The apparatus of claim 1 wherein the nozzles define an air feed arranged to take place from beneath the holder frame of the doctor blade.

6. The apparatus of claim 1 wherein the nozzles are formed by a perforation made to a side of the beam opposite the paper web and are arranged in an upper part of the beam.

7. The apparatus of claim 1 wherein the doctor blade is supported in a holder frame, and the holder frame has a streamlined shaped lower surface arranged to be used to guide the stream of air towards the throat.

8. The apparatus of claim 1 wherein the doctor blade attached to the beam is arranged to oscillate.

9. The apparatus of claim 1 wherein the beam is arranged to oscillate.

10. The apparatus of claim 1 wherein the holder frame of the doctor blade is arranged to oscillate.

11. A multi-cylinder dryer in a paper machine, said dryer having a plurality of cylinders and a paper web passing over the cylinders, comprising:

a first drying cylinder, having a drying surface;

at least one vacuum roll or roll in which a suction effect is induced, located at a different height than the drying cylinder and spaced a distance downstream in a machine direction from the drying cylinder;

a paper web traversing the drying cylinder to the roll;

a beam located upstream of the paper web traversing the drying cylinder to the roll, in the machine direction, and below the first drying cylinder, the beam forming an air duct, and a plurality of nozzles connected to the air duct, the plurality of nozzles arranged to direct a stream of air into a throat formed between the drying cylinder and the paper web;

a doctor blade supported in a holder frame, and mounted between loading devices mounted to the holder frame, the holder frame mounted to the beam, and the doctor blade engageable with the drying cylinder to keep the surface of the drying cylinder clean;

wherein the beam and the doctor blade are arranged jointly with the section of the paper web and the roll to form a smooth high channel, the smooth high channel defining an opening angle, the smooth high channel on an upstream side of the roll, the smooth high channel for passage of the web during a disturbance, and wherein the opening angle of the said channel is 3 to 10 degrees; and wherein the beam has a downwardly facing surface to which is attached a moisture sensor or a web-monitoring apparatus.

12. A multi-cylinder dryer in a paper machine, comprising:

a drying cylinder, having a drying surface;

at least one roll located at a different height than the drying cylinder and spaced a distance downstream in a machine direction from the drying cylinder;

a paper web having a section traversing the drying cylinder to the roll;

a beam located upstream of the paper web section in the machine direction, the beam forming an air duct, and a plurality of nozzles connected to the air duct to direct a stream of air into an opening throat formed between the drying cylinder and the section of paper web;

a doctor blade mounted to the beam by a holder frame, the doctor blade engageable with the drying surface of the drying cylinder to keep the surface clean;

loading devices supported by the beam and which engage the doctor blade holder frame, wherein the beam, the holder frame and the doctor blade are arranged jointly with the roll and the section of the paper web, to form a smooth high channel on an upstream side of the roll for passage of the web during a disturbance, the smooth high channel defining an opening angle, and wherein the holder frame of the doctor blade forms a smooth continuation to the beam which extends towards the opening throat so that the distance of the holder frame at right angles to the section of the paper web increases as the throat opens in the direction of travel of the paper web; and wherein the profile of the beam is high in relation to its width.

13. The apparatus of claim 12 wherein the profile of the beam is 3 to 5 times as high as its width.

14. The apparatus of claim 12 wherein the beam is arranged to be turned around a shaft between an operating position and a maintenance position.

15. The apparatus of claim 12 wherein a moisture sensor and a web-monitoring apparatus are arranged on a bottom portion of the beam.

16. The apparatus of claim 12 wherein the nozzles define an air feed and are arranged beneath the holder frame of the doctor blade.

17. The apparatus of claim 12 wherein the nozzles are formed by a perforation made to a side of the beam opposite the paper web and are arranged in an upper part of the beam.

18. The apparatus of claim 12 wherein the doctor blade attached to the beam is arranged to oscillate.

19. The apparatus of claim 12 wherein the beam is arranged to oscillate.

20. The apparatus of claim 12 wherein the holder frame of the doctor blade is arranged to oscillate.

21. The apparatus of claim 12 wherein the opening angle of the smooth high channel is 3 to 10 degrees.

* * * * *